US005096109A

United States Patent [19]

Chen

[11] Patent Number: 5,096,109

[45] Date of Patent: Mar. 17, 1992

[54] FASTENER DRIVING DEVICE WITH IMPROVED FEEDING MECHANISM

[75] Inventor: Hong F. Chen, Taichung, Taiwan

[73] Assignee: Bex Nailing Machine Co., Ltd., Tachung, Taiwan

[21] Appl. No.: 636,898

[22] Filed: Jan. 2, 1991

[51] Int. Cl.[5] ..... B25C 1/00; B27F 7/13

[52] U.S. Cl. ..... 227/109; 227/120

[58] Field of Search ..... 227/120, 109, 127, 135

[56] References Cited

U.S. PATENT DOCUMENTS

| | | | |
|---|---|---|---|
| 3,266,698 | 8/1966 | Dickson | 227/120 |
| 4,749,115 | 6/1988 | Fehrs | 227/127 X |
| 4,815,647 | 3/1989 | Chou | 227/120 X |
| 5,005,750 | 4/1991 | Scala | 227/109 |

FOREIGN PATENT DOCUMENTS 2743906 4/1979 Fed. Rep. of Germany ..... 227/109

*Primary Examiner*—Frank T. Yost
*Assistant Examiner*—C. Dexter
*Attorney, Agent, or Firm*—Pollock, Vande Sande & Priddy

[57] ABSTRACT

Provided is a fastener driving device with an improved fastener feeding means. The fastener driver and the fastener feeder are interconnected. An improved fastener feeding mechanism includes a shaft substantially perpendicular to the drive track. The axial shaft having a multiplicity of elongated grooves of various depths radially disposed therein. One end of the shaft is pivotally inserted into the mounting element of the driving device with the other end being pivotally provided at the rear portion of the feeding device. The fastener driving device has a fastener supporting plate at the lower portion of the feeding device.

8 Claims, 5 Drawing Sheets

FASTENER DRIVING DEVICE WITH IMPROVED FEEDING MECHANISM

TECHNICAL FIELD

The present invention relates to fastener driving devices and particularly to improvements in the feeding mechanisms of such devices for driving rows of brads.

BACKGROUND OF THE INVENTION

Suitable nails for use in connection with the present invention as shown in FIGS. 1 and 2 are a type of brads 10, such brads have various different lengths and their major application is joining two workpieces of different thickness.

In the structure of conventional fastener driving devices which use rows of brads, in order to adapt a driving device to brads of various different lengths, a flange 21 with a recess 211 is provided at the lower portion of the body of the fastener feeding means. Holes 22*a*, 22*b*, 22*c*, etc. for receiving screws are provided at different heights of the body 20 so that a follower plate 23 can be affixed to the body 20 at different heights by means of screws 24; the clearance formed between the lower opening 231 of the follower plate 23 and the recess 211 of the body 20 defines a drive track and can be of various heights.

In such conventional devices, whether in loading or replacing rows of brads, it is necessary to loosen the two screws 24' on the follower plate 23 first and then secure the follower plate 23 again at an appropriate height. This operation is very troublesome and really demands improvements in the feeding mechanism.

SUMMARY OF THE INVENTION

A primary object of the present invention is to provide an improved feeding mechanism for fastener driving devices for feeding rows of brads having different lengths, wherein by a simple turning of the knob portion the height of the fastener feeding slot can be adjusted, eliminating the need to disengage any parts of the device.

A further object of the present invention is to offer a shaft pivotally provided in the magazine housing of the fastener feeding means, the shaft having a multiplicity of elongated grooves of various depths radially disposed therein to define feeding tracks.

Preferred embodiments are set forth in the following description in connection with the accompanying drawings, but it is to be understood that the description and accompany drawings are for the purpose of illustration only and do not limit the scope of the appended claims.

DETAILED DESCRIPTION OF THE PREFERRED EMBODIMENTS

In order to simplify the operation of adjusting the height of the feeding slot of the fastener feeding means of a fastener driving device according to the present invention, a fastener supporting plate is inserted onto the rail members at the lower portion of the magazine housing, and a shaft being substantially parallel to the fastener supporting plate and having a multiplicity of elongated grooves of various depths radially disposed therein is pivotally disposed in the through hole of the magazine housing, with one end of the shaft projecting into a striking zone and the other end sticking out of the magazine housing to form a turnable knob portion for turning operation of the shaft; a positioning means is provided in the magazine housing for locking the shaft so that when any one of the elongated grooves is aligned with the drive track the shaft will not freely rotate.

Figure 4:
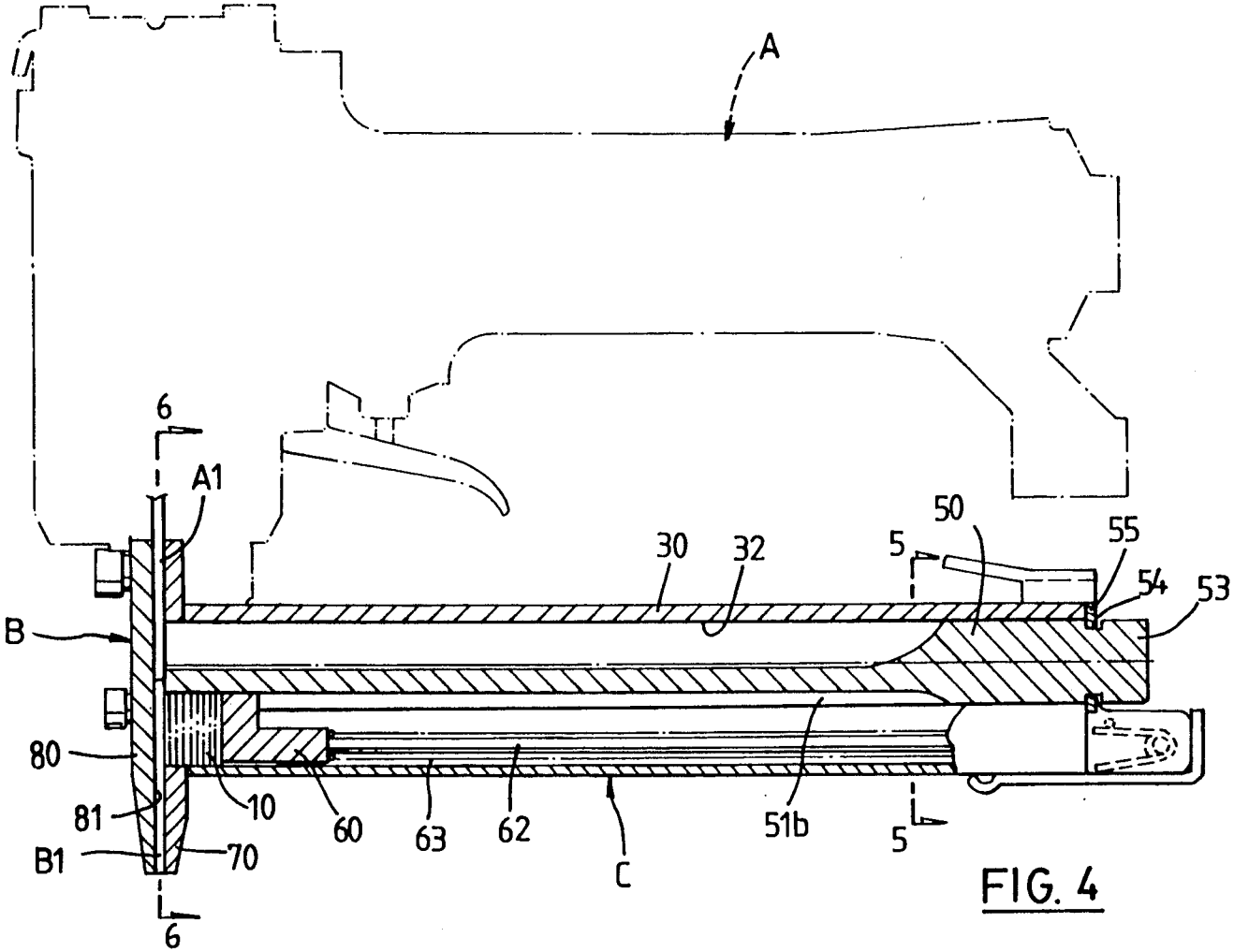
FIG. 4 is a front sectional view of the first preferred embodiment of the present invention.

FIG. 4 shows the overall structure of a fastener driving device chiefly comprising three major parts: a body A which is capable of generating a stroke, a fastener driving means B, and a fastener feeding means C. The fastener feeding means C is provided for receiving a supply of rows of brads and for feeding brads one by one into the striking zone of the fastener driving means B, so that a striking element A1 of the body A can effect a stroke to drive the fastener along the drive track B1 into a workpiece.

Figure 2:
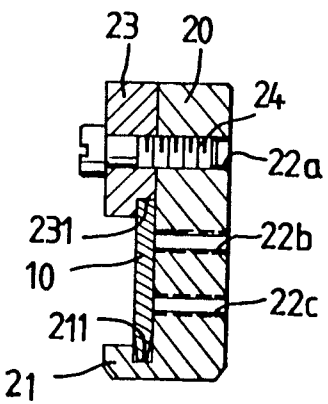
FIG. 2 PRIOR ART
FIG. 2 is a sectional view taken along the line 2—2 of FIG. 1.
Figure 1:
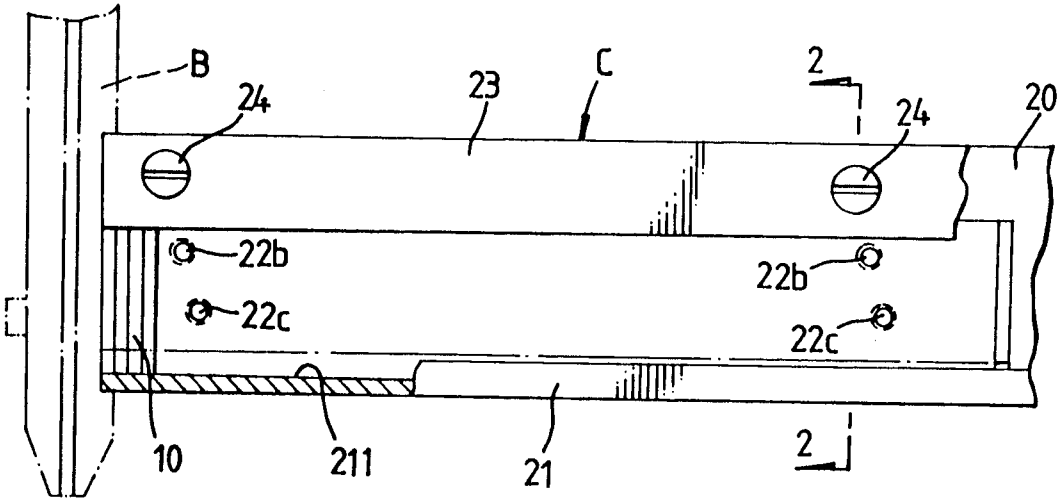
FIG. 1 PRIOR ART
FIG. 1 is a front view of a conventional fastener driving device.
Figure 3:
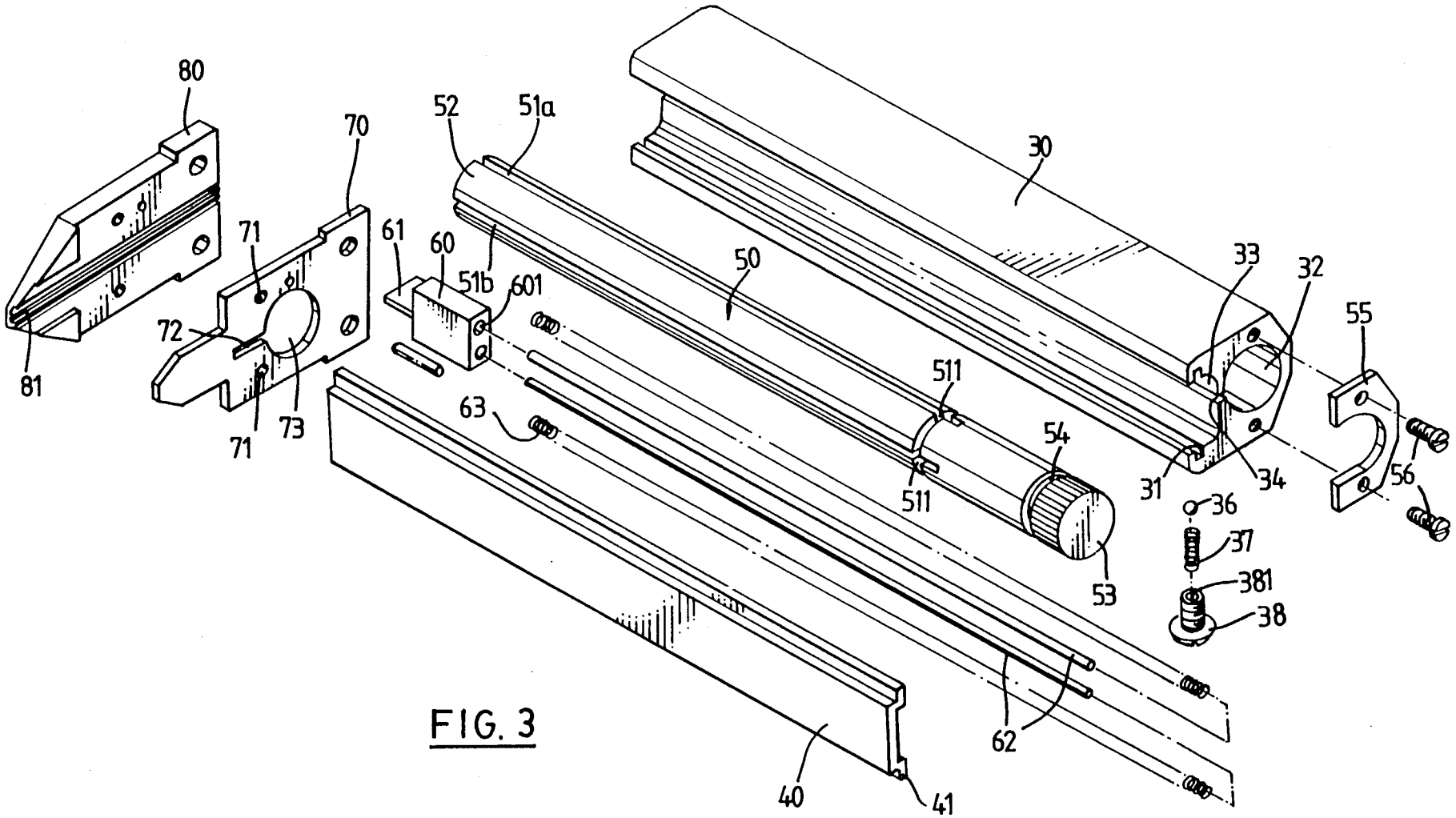
FIG. 3 is an exploded perspective view of a first preferred embodiment of the present invention.

The present invention is particularly concerned with the improvements in the feeding mechanism; improvements are also provided for parts of the driving mechanism which are related to the feeding mechanism. Therefore, FIG. 3 shows only the improved parts of the present invention, and the body A of the fastener driving device will not be described in detail.

In the first preferred embodiment shown in the drawing, the upper half portion of the fastener feeding means C has a magazine housing 30 with a rail member 31 at the lower portion thereof; a fastener supporting plate 40 having two lateral sides 41 is provided at the lower half portion of the fastener feeding means C so that the fastener supporting plate 40 can be slidably inserted onto the rail members 31.

The upper half portion of the magazine housing 30 has a through hole 32 being substantially parallel to the rail members 31 for pivotally disposing therein a shaft 50. The shaft 50 has a multiplicity of elongated grooves 51*a*, 51*b*, 51*c*, etc. radially disposed therein, each of these elongated grooves having a different depth. These elongated grooves axially extend through at least the end portion 52 of a first end of the shaft 50, this end portion 52 being the part that pivotally joins the fastener. driving means B; a second end 53 of the shaft 50 sticks out of the magazine housing 30 forming a turnable knob portion.

As shown in FIG. 4, the turnable knob portion has a neck 54; a jaw-shape piece 55 is secured onto the magazine housing 30 by means of screws 56 so as to grip the neck 54 of the shaft 50 to prevent any axial movement of the shaft 50.

The lower half portion of the magazine housing 30 is provided with a chamber 33 for the movement of a fastener urging means 60. Disposed between the chamber 33 and the through hole 32 is a slot 34. The fastener urging means 60 is a conventional structure which generally includes a fastener urging piece 61 having a thickness similar to the width of the fasteners, rods 62 passing through holes 601 of the fastener urging means 60 and being secured in holes 71 provided in the mounting element 70 of the fastener driving means B so that the fastener urging means 60 can make use of the rods 62 as a rails to slidably move within the chamber 33, a coil spring 63 is sleeved onto each of the rods 62 to urge the fastener urging means 60 from the rear so that the fastener urging piece 61 can push the brads one by one into the fastener driving means B. As a general rule, when the fastener supporting plate 40 moves backward, it pulls the fastener urging means 60 backward with it so that it is possible to load brads from the lower portion of the fastener feeding means C. As such is a common practice, it is not considered necessary to discuss in detail.

Figure 5:
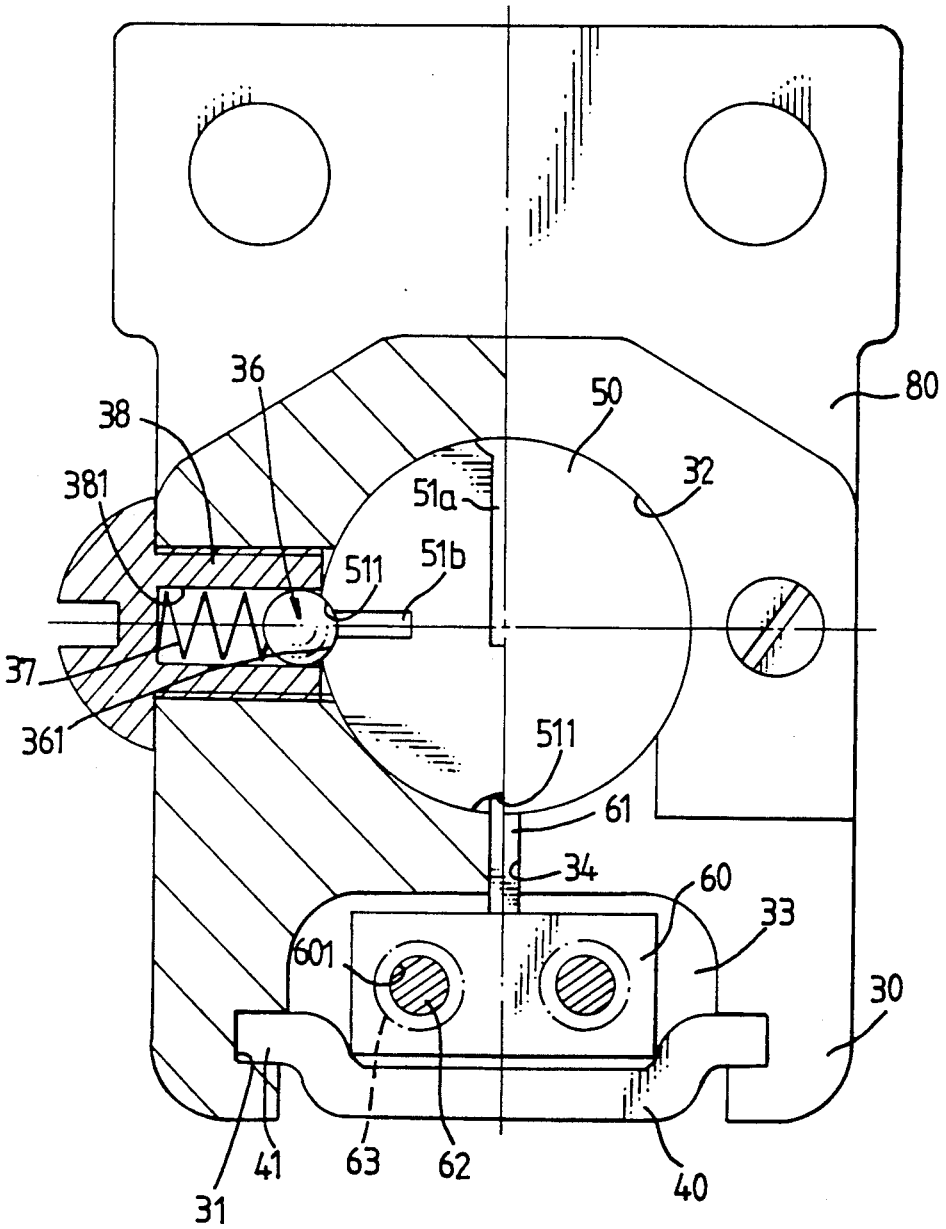
FIG. 5 is a sectional view taken along the line 5—5 of FIG. 4.

To prevent the shaft 50 in the magazine housing 30 from rotating freely, a positioning means is provided in the magazine housing 30. A preferred embodiment of the positioning means is illustrated in FIG. 5, which includes a movable nose member 361 provided in the magazine housing 30 and a corresponding recess 511 disposed around the shaft 50 at any corresponding location. A comparatively simple way is to have the edge portion of each elongated groove in the shaft 50 enlarged to form a recess 511. The way to form a nose member is to provide a screw hole 35 in the magazine housing 30 to align with the center of the through hole 32 mentioned above, but the part of the screw in immediate contact with the through hole 32 has to partially occlude a hole 381 in a screw 38 to permit only partial passage of a ball 36. A spring member 37, characteristically a compression spring, is provided in a hole 381 of a screw 38. After the screw 38 is screwed into a screw hole 35, the spring member 37 can urge the ball 36 to partially project into the through hole 32 to form a nose which just fits into the recess 511 of the shaft 50 to prevent the shaft 50 from rotating freely. Such a characteristic feature is made possible when any one of the elongated grooves in the shaft 50 is aligned with the drive track of the fastener driving means B. Therefore, when the shaft 50 turns and stops at any set position, there will be an elongated groove aligning with the drive track to ensure that the fastener feeding mechanism is unimpeded.

Figure 7:
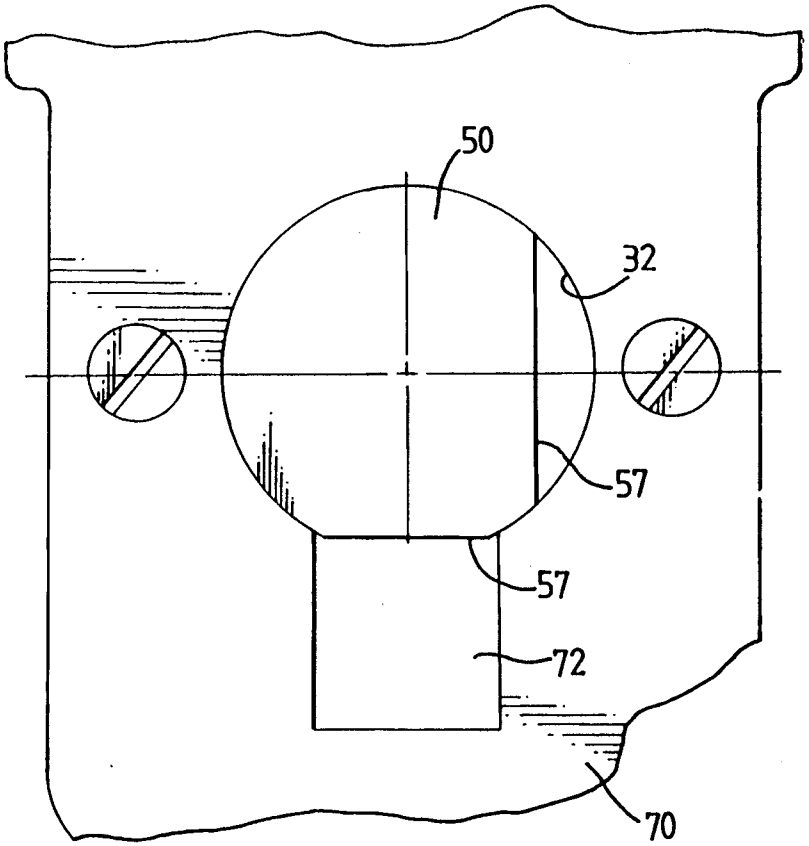
FIG. 7 is similar to FIG. 6, showing a second preferred embodiment of the present invention.
Figure 6:
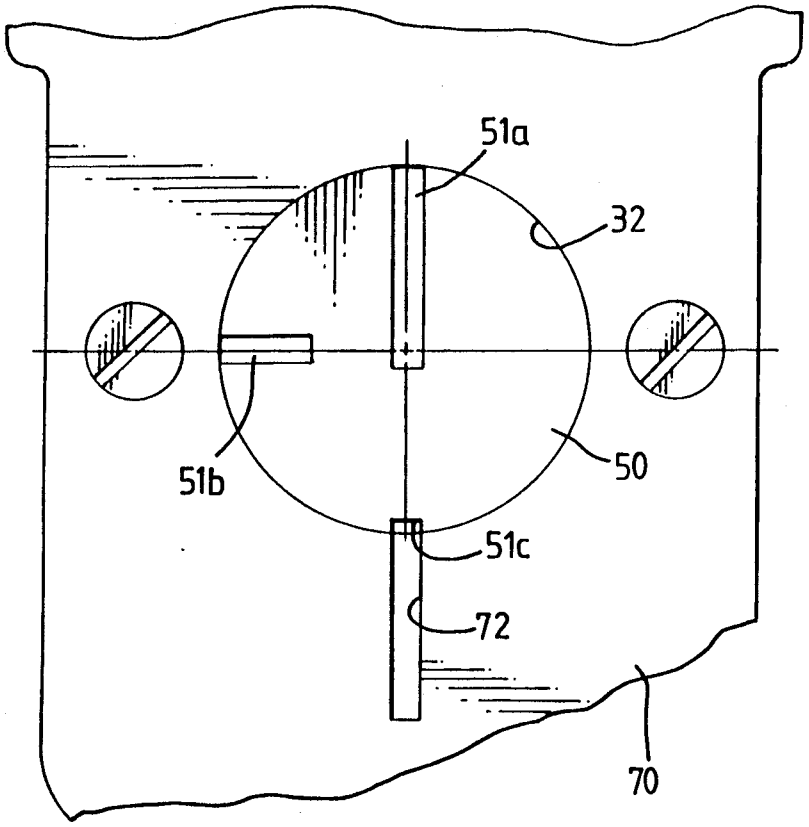
FIG. 6 is a sectional view taken along the line 6—6 of FIG. 4.

For brads of greater width, a second preferred embodiment according to the present invention as shown in FIG. 7 can be adopted. The structure of this modified embodiment is similar to that of the first preferred embodiment illustrated above except in the formation of the grooves. In this modified embodiment, grooves of an appropriate depth are arranged to extend along a tangential direction of the shaft 50 to the edge thereof and then axially extend to form plane surfaces 57. In other words, compared to the elongated grooves described above, the fastener feeding slots illustrated herein are formed of plane surfaces. To correspond to the modification of the grooves it is certain that the slot 34, provided between the through hole 32 of the magazine housing 30 and the chamber 33, and the slot 72 of the mounting element 70 of the fastener driving means B described above should be consequently enlarged.

The mounting element 70 in the fastening driving means B is generally screwed together with a face plate 80, the mounting element 70 having a hole 73 for pivotally disposing therein the first end of the shaft 50 mentioned above. The face plate 80 has a fastener drive slot 81. The clearance between the fastener drive slot 81 and the mounting element 70, as shown in FIG. 4, forms the striking zone and the drive track B1 wherein the striking element Al can perform an upward or downward movement. The end portion of the first end of the shaft 50 is therefore adjacent to the striking element Al. The edge of the hole 73 of the mounting element 70 is provided with a slot 72 which is parallel to the drive track and extends radially to form a final passage for the brads into the striking zone. It is possible to form the mounting element 70 of the fastener driving means B into two parts: the upper portion is fixed and is pivotally provided with the shaft 50 by means of the hole 73; the lower portion includes the slot 72 and can be secured at the front edge of the fastener supporting plate 40 and can move with the movement of the fastener supporting plate 40. All these are only extensions of the present invention.

As illustrated above, the present invention provides a fastener feeding mechanism for a fastener driving device which is simple in operation and efficient in replacement of brads of various lengths. But it is to be understood that the foregoing embodiments are taken as examples for merely illustrating the practicability of the present invention and should not be treated as a limitation to the scope of the claims.

What is claimed is:

1. A fastener driving device comprising a fastener feeding means and an interconnected fastener driving means, said fastener feeding means comprising a fastener supporting plate, and a magazine housing having a through hole, said through hole having a shaft substantially parallel to said fastener supporting plate pivotally disposed therein, said shaft having a first end and a second end and a multiplicity of elongated grooves of various depths radially disposed therein and axially extending through at least the end portion of said first end to form a multiplicity of fastener feeding slots, said first end of said shaft being pivotally disposed in a mounting element of a fastener driving means, said first end and a drive slot of a face plate of said fastener driving means forming a clearance therebetween to define a drive track, said second end of said shaft forming a turnable knob portion for turning operation of said shaft.

2. A fastener driving device as claimed in claim 1, wherein each of said elongated grooves disposed in said shaft and axially extending along said shaft has a certain depth and extends to the edge of said shaft along a tangential direction of said shaft to form a plane surface.

3. A fastener driving device as claimed in claim 2, wherein said mounting element of said fastener driving means has a round hole for pivotally receiving said first end of said shaft.

4. A fastener driving device as claimed in claim 1, further comprising a positioning means for locking the shaft so that when any one of said elongated grooves aligns with said drive track said shaft will not turn.

5. A fastener driving device as claimed in claim 4, wherein said positioning means includes a movable nose member being securely provided in said magazine housing having pivotally disposed therein said shaft, and a multiplicity of recesses disposed around said shaft and located at positions corresponding to the location of said nose member, each of said recesses being formed by partial enlargement of the edge of each of said elongated grooves in said shaft, said nose member including a ball and a spring member secured in said magazine housing, said spring member being disposed at the rear of said ball so as to urge said ball to slightly project into said through hole in said magazine housing to fit into any one of said recesses.

6. A fastener driving device as claimed in claim 1, wherein said mounting element of said fastener driving means has a round hole for pivotally receiving said first end of said shaft.

7. A fastener driving device as claimed in claim 6, wherein said mounting element of said fastener driving means has a slot which radially extends from the edge of said round hole and is parallel to said drive track.

8. A fastener driving device as claimed in claim 1, wherein said fastener supporting plate is slidably inserted onto a rail member provided at the lower portion of said fastener feeding means. fastener driving means has a slot which radially extends from the edge of said round hole and is parallel to said drive track.

* * * * *